United States Patent [19]

Fröhlich et al.

[11] 4,404,998

[45] Sep. 20, 1983

[54] WOVEN SLIDE FASTENER STRINGER

[75] Inventors: Alfons Fröhlich; Karl Griessbaum, both of Essen, Fed. Rep. of Germany

[73] Assignee: Opti Patent-, Forschungs- und Fabrikations AG, Riedern-Allmeind, Switzerland

[21] Appl. No.: 199,831

[22] Filed: Oct. 23, 1980

Related U.S. Application Data

[63] Continuation-in-part of Ser. No. 33,224, Apr. 25, 1979, Pat. No. 4,334,556.

[30] Foreign Application Priority Data

Apr. 27, 1978 [DE] Fed. Rep. of Germany ..... 2818383
Apr. 27, 1978 [DE] Fed. Rep. of Germany ..... 2818508
Apr. 27, 1978 [DE] Fed. Rep. of Germany ..... 2818509

[51] Int. Cl.[3] ..... D03D 1/00; A44B 19/34
[52] U.S. Cl. ..... 139/384 B; 24/205.16 C
[58] Field of Search ..... 139/384 B, 384 R, 116; 24/205.1 C, 205.13 C, 205.16 C

[56] References Cited

U.S. PATENT DOCUMENTS 3,807,462 4/1974 Nogai ..... 139/384 B
3,847,188 11/1974 Aver et al. ..... 139/384 B
3,880,203 4/1975 Frohlich ..... 139/384 B
3,901,291 8/1975 Nogai ..... 139/384 B
3,945,407 3/1976 Jakob ..... 139/384 B
3,961,652 6/1976 Hasuda et al. ..... 139/384 B
4,191,220 3/1980 Yoshida et al. ..... 139/384 B

FOREIGN PATENT DOCUMENTS 1945315 3/1971 Fed. Rep. of Germany ... 24/205.16 C
2707357 8/1978 Fed. Rep. of Germany ... 24/205.16 C

*Primary Examiner*—James Kee Chi
*Attorney, Agent, or Firm*—Karl F. Ross; Herbert Dubno

[57] ABSTRACT

A slide fastener stringer of the woven type in which the tape has a ground weave provided with warp threads and a weft formed of double-weft passes on a needle loom. The coupling element is of the continuous, preferably coil, monofilament synthetic-resin type in which the shanks of each coupling member are formed as a double-weft connected in the weaving process with the ground weave of the tape. According to the invention, the warp passes receiving the double-weft of the ground weave are separate from the warp passes receiving the double-wefts of the monofilament and are spaced or offset therefrom in a direction orthogonal to the slide fastener plane. Some of the warp threads form the passes over the double-weft of the ground weave and run over the shanks to form the passes for the double-weft of the monofilament.

5 Claims, 7 Drawing Figures

WOVEN SLIDE FASTENER STRINGER

CROSS REFERENCE TO RELATED APPLICATION

This application is a continuation-in-part of Ser. No. 033,224 filed Apr. 25, 1979, now U.S. Pat. No. 4,334,556 issued June 15, 1982.

FIELD OF THE INVENTION

The present invention relates to a slide fastener and, more particularly, to a slide fastener having a synthetic-resin monofilament coupling element woven into a support tape.

BACKGROUND OF THE INVENTION

Slide fasteners of the woven-tape type generally comprise a pair of tapes which are adapted to be stitched to a garment or other fabric or nonfabric article or otherwise secured thereto, each of the tapes being provided along an edge with a row of coupling heads interdigitatable with the opposing row of coupling heads upon movement of the slide along the rows.

It is known to provide each row of coupling heads unitarily in a synthetic-resin monofilament or strand which is bent to form the coupling heads at respective turns of a coil or meander pattern so that a pair of shanks can extend away from each head and are joined to the shanks of adjacent coupling members (each formed by a head and a pair of shanks) at a respective bend, hereinafter referred to as a bight.

When the coupling element is woven into the respective support tape, which can consist of warp threads interwoven with weft threads lying in a double-weft configuration (i.e. two adjacent weft passes form each weft), the weft threads can be looped around the warp in the region of the coupling element which can form a warp-like strand in the weave from which the heads project laterally along an edge of the tape.

The shanks of the coupling element can form part of the weft, i.e. a double-weft, when they lie adjacent one another, usually in a superposed configuration with one shank of each member lying directly over the other so that both shanks have a common projection in the slide-fastener plane.

The ground-weave weft threads can run to the regions of the coupling heads and the coupling members can be anchored to the support tape in part by warp threads interwoven with the double-weft formed by the shanks.

While, as noted, the coupling elements can be either of the helical-coil type or the meander type, the preferred configuration for the present purposes is the coil.

A woven slide-fastener stringer half is described in German patent publication-Auslegeschrift DE-AS No. 17 85 363 in which the ground weft threads of the double-weft of the support tape lie adjacent the shanks of the coupling members. In a section orthogonal to the plane of the slide fastener, these ground-weave wefts lie midway between the upper and lower shanks. Hence the shanks of each coupling member are substantially symmetrically disposed to either side of the plane of the tape and project therefrom by at least the thickness of the monofilament and half the height of the eye or loop formed by each coupling member at the respective head.

In this system, the two superposed shanks of each coupling member and the associated double-weft of the ground weft always lie in one and the same warp shed, i.e. are both passed over and under simultaneously by given warp threads. This is a consequence of the nature of the weft insertion by the weft-carrying needle looms used in fabricating these earlier stringers. The term "shed" as used herein refers to positions during weaving. These "sheds" become yarn "passes" in the finished article.

While such techniques are effective in the formation of supple tapes from ordinary threads, they are found to pose problems when synthetic-resin coupling elements with thicknesses of 0.4 mm or more are used and which, by comparison with the ground weft threads and with the warp threads are relatively stiff and only limitedly bendable.

The integration of such coupling elements into the support tape has been found to be fraught with problems because of fluctuating and increased mechanical stress which can give rise to variations in the interhead spacing.

Frequently during the normal handling of the stringer, bending can result, i.e. in textile or manufacturing operations or even in use. With systems of the type described, the bending of the finished stringer or slide fastener can result in kinking of the coupling element which may be stressed during weaving and which can create problems when the slide fastener is to be sewn into a garment or the like.

Many of these problems have been traced to the fact that the coupling element is woven in place under the stresses generated by the weaving process so that relative movement of the coupling element and the support tape parts is not possible. When the tension of the tape is relieved, bending and buckling tendencies arise. Furthermore, the resulting slide fastener is not sufficiently flexible and soft for many modern applications and thus has not received wide-spread acceptance.

Greater success has been achieved with constructions of the type described in German patent publication-Auslegeschrift DE-AS No. 20 23 005 in which the double-weft of the support tape is formed by ground weft threads while the synthetic-resin monofilament coupling element is formed in situ by coiling the monofilament on a mandrel so that it forms a warp strand which does not constitute any significant part of the weft but is locked in by the ground weft.

This system loses some of the advantages of double-weft insertion and does not utilize fully the possibilities of weft-insertion needle looms. This system also is not capable of truly high speed fabrication.

OBJECTS OF THE INVENTION

It is the principal object of the present invention to provide an improved slide fastener stringer which has a precise intershed or interpass spacing and sufficient softness, pliability and flexibility for modern textile-industry applications.

Another object of this invention is to provide an improved woven slide fastener stringer which can more fully utilize modern needle-loom technology with double-weft insertion for both the ground-weave weft and for the monofilament shank weft.

Yet another object of this invention is to provide an improved method of making a woven slide fastener stringer.

SUMMARY OF THE INVENTION

These objects and others which will become apparent hereinafter are attained, in accordance with the present invention, in a woven slide-fastener stringer half having a ground-weave fabric formed with needle-inserted double-weft threads and with warp threads interwoven with the weft threads to form the support tape, and a synthetic-resin monofilament coupling element whose coupling members each have a head interdigitatable with heads of an opposing coupling element and a pair of shanks running rearwardly from the head and interwoven with the ground weave as a double-weft, the shanks of each member being connected to adjacent members at respective bights remote from the heads.

According to the invention the ground-weave weft thread double-weft passes, on the one hand, and the monofilament double-weft passes on the other hand lie in separate warp sheds offset from one another in a direction orthogonal to the slide fastener plane.

In one embodiment of the invention, which can be fabricated with especially high speeds and is very pliable and soft, each double-weft or at least every other or every third double-weft of the ground weave is disposed below the coupling element in a respective ground-weave warp pass, with at least some of the warp threads forming such sheds passing out of the slide-fastener plane, the shanks of the coupling element and forming all or part of respective passes (connective passes) binding the coupling element into the ground weave.

The reference to "below the coupling element" is intended to indicate any location below the level of the coupling element of a coupling member thereof, i.e. directly therebeneath or laterally shifted from a location directly below a coupling member to a location between two coupling members or even beneath an adjacent coupling member. In a slide-fastener stringer according to the invention, therefore, the ground-weave double-wefts of the two types and monofilament double-wefts of the respective coupling elements lie in separate warp passes which are located one above on another orthogonal to the slide-fastener plane with the connection ensured by the fact that at least several, usually many, warp threads pass from the ground weave over the double-weft shanks of the monofilament into the warp passes (connective passes) individual thereto.

The slide-fastener has been found to be especially soft and flexible, apparently because the weft threads of the support tape and the tape itself permit such movements of the coupling members, even upon bending of the stringer out of the slide fastener plane, that detrimental stresses do not arise. However, the connection between the coupling element and the tape affords extremely stable interhead spacings which are maintained even upon washing, dyeing and ironing of the products in which the slide fastener is incorporated. This applies as to fine coupling elements as well as to thick monofilaments. Thus the thickness of the monofilament can be selected over a wide range with respect to the thickness and strength of the textile tape.

In a preferred embodiment of the invention, which constitutes the best mode providing high fabrication speed and optimum characteristics, between the double-wefts of the ground weave (which lie under the coupling members) an intermediate double-weft of the ground weave is disposed approximately midway between neighboring coupling members.

Each two double-wefts of the ground weave are received in a common warp shed while each double-weft of the monofilament is received in a warp shed of warp threads offset in the longitudinal direction of the slide fastener and passing over two monofilament double-wefts. Thus each of these latter threads passes alternately over two monofilament double-wefts and under the next two monofilament double-wefts. Others of these threads pass over and under pairs of monofilament double-wefts including one monofilament double-weft of each of the first mentioned pairs.

Modifications of this arrangement can have groups of three or more ground-weave double-wefts and groups of three or more in respective passes. Conversely, each upper and lower pass can receive only a single double-weft and the systems can be combined so that the ground weave double-wefts and the monofilament double-wefts are in different numbers within the respective warp sheds.

When the slide-fastener stringer is to be capable of withstanding high longitudinal (tensile) stresses and high transverse stresses, it is desirable that several of the warp threads, even in the region of the coupling element, be found only in the sheds of the support tape, i.e. not pass over the double-wefts formed by the shanks.

A slide-fastener stringer with especially high stability under bending stress in which the stringer tends to be bent out of the slide fastener plane as well as with the plane, and a high resistance to kinking and transverse stress is ensured in an embodiment of the invention in which warp threads extending out of the slide fastener plane, are disposed in the slide fastener length one after the other between one or between a plurality of coupling members while the corresponding double-wefts of the ground weave pass over one or more coupling members to cover them and thereupon extend back into the support tape to form further ground-weave sheds.

In yet another embodiment of the invention, the ground weave double-wefts and the monofilament double-wefts are received in superposed but separate warp sheds, which are offset orthogonally to the slide fastener plane and whose warp threads extend through a cycle of high-middle-low-middle all along the length of the slide fastener. When the warp threads assume the latter pattern, common warp thread pockets for the ground-weave double-wefts and the monofilament double-weft are no longer provided since both types of double-wefts are received in respective fabric structures disposed one above the other to tie in the ground weave double-wefts and the monofilament double-wefts respectively.

The tape thus constitutes one woven structure while the double-weft of the coupling element and the warp yarns forming sheds for this double-weft constitute a second woven structure overlying the first. The two structures are intimately connected together by the warp threads which pass alternately between them and which can alternate with one another across the stringer in forming a connective shed for the coupling element or a shed of the ground fabric or tape. The interleaved character of the two fabric structures serves to stabilize the coupling element against change of the interhead spacing so that high warp thread tensions are no longer required for this purpose.

Since the thread density in the region of the coupling elements is not increased, the stringer half has high flexibility.

The double-wefts of the tape and the monofilament double-wefts are always in separate warp passes so that the openings of the weave can be held extremely small.

Since the warp thread tension can be reduced by comparison with earlier systems, especially high weaving speeds can be attained.

In one embodiment of the invention, eight warp threads are used to form the connective sheds, advantageously in close relationship to one another, with successive warp yarns from this group passing over successive coupling members in forming the connective passes.

In this case, the shanks of the relatively tight coil formed by the monofilament can lie substantially one above the other so as to have a common projection on the slide fastener plane.

In a further embodiment of the invention, the warp threads forming the connective sheds can have a high-middle-low-middle pattern which is repeated along the length of the slide fastener so that each of these warp yarns passes over a coupling member in the "high" position, between the next coupling member and an underlying double-weft of the tape in each of the two "middle" positions and under a double-weft of the tape in the "low" position.

In this case, at least four warp yarns are used and preferably a multiple of four warp yarns form the connective passes.

In still another embodiment of the invention, the warp yarns have a high-high-middle-low pattern and preferably at least eight yarns are provided.

In all of these cases it is advantageous to form the warp threads in mutually contacting relationships when they constitute the connective sheds and the separate sheds engaging the double-wefts of the tape.

In embodiments in which the loop-forming coupling heads lie in planes orthogonal to the slide fastener plane and to the slide fastener axis, especially effective results are obtained because the coupling element is stabilized by the mutual support-type contact between the shanks in addition to the shedding arrangement against change of the interhead spacing.

BRIEF DESCRIPTION OF THE DRAWING

The above and other objects, features and advantages of the present invention will become readily apparent from the following description, reference being made to the accompanying drawing in which.

SPECIFIC DESCRIPTION

Figure 1:
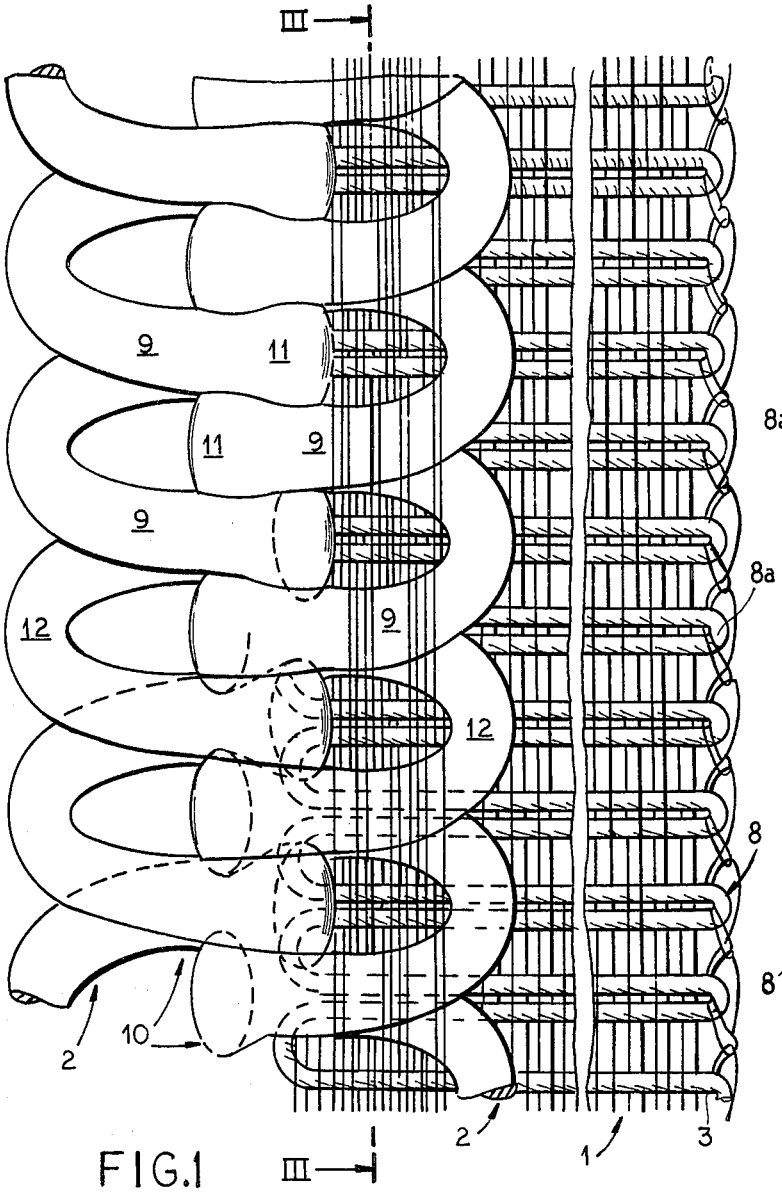
FIG. 1 is a diagrammatic plan view of one stringer half of a slide-fastener stringer embodying the invention and of which only the coupling element of the other stringer half has been illustrated.

Throughout this description, corresponding reference numerals will be used to designate identical or identically functioning structures. Reference numerals in respective hundreds series have been used to indicate similarly functioning elements where major structural differences exist. Throughout the weft and warp threads are shown by double line or single line illustration, as may be desirable for effective understanding of the invention, and frequently threads are shaded or shown with different textures to enable them to be distinguished from other threads in a particular group.

FIGS. 1 through 4 show a woven slide fastener stringer in which the support tape 1 is woven from weft and warp yarns and into which the continuous coupling element 2 of a synthetic resin monofilament, has been woven.

For convenience of illustration, the weft threads 3 of the support tape 1 are shown disproportionately thick while the warp threads 4, 5, 6 and 7 are represented proportionately thinner than reality, namely, as single lines. In practice, both the warp and weft threads of the fabric can have the same or only slightly different thickness.

Figure 3:
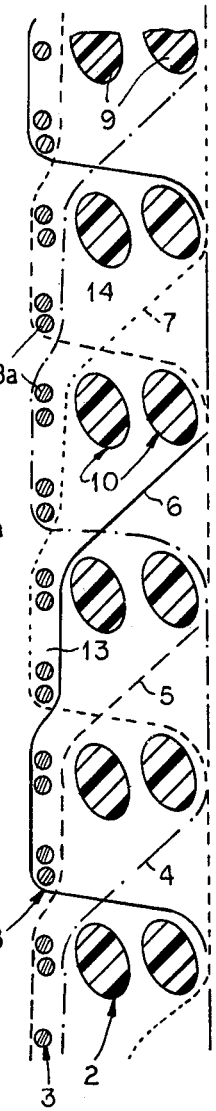
FIG. 3 is a cross-sectional view taken along the line III—III of FIG. 1.
Figure 4:
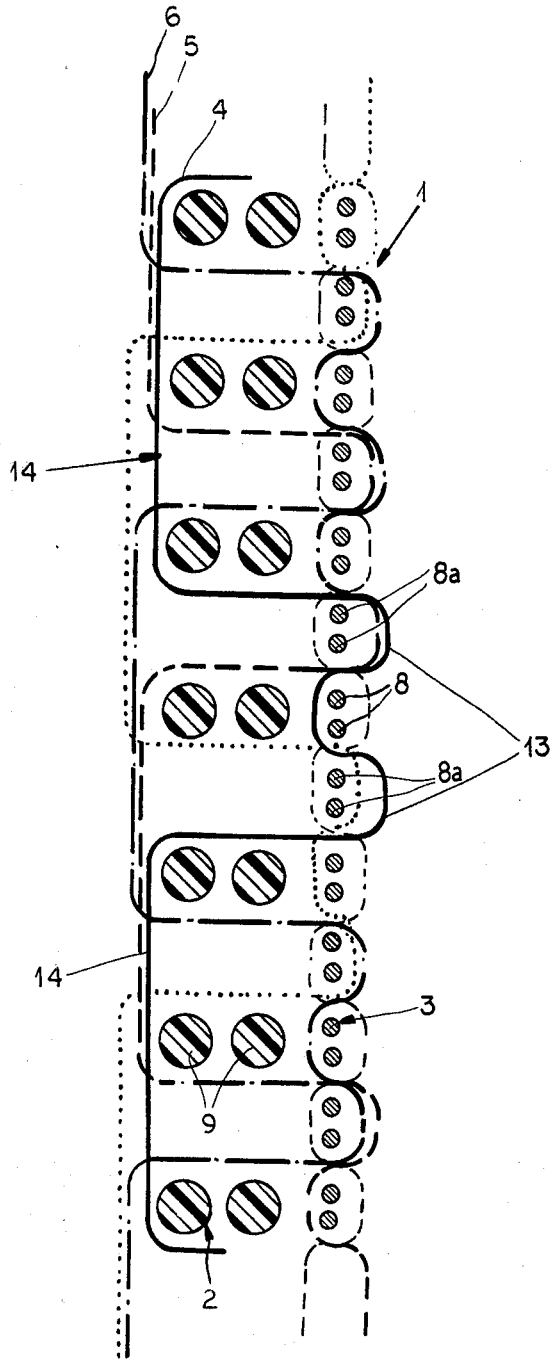
FIG. 4 is a view similar to FIG. 3 of another embodiment of the invention in which the coupling-element double weft and the ground-weave double weft underlying same are enclosed in different warp passes.

In the illustration of FIGS. 3 and 4, earp threads involved in different passes have also been represented diagrammatically by broken dot-dash or dotted lines for convenience.

As will be apparent from FIGS. 1 through 4, the support tape 1 is constituted by the warp threads 4, 5, 6, 7 and double-weft passes 8 of the weft thread or yarn 3. Double-weft passes (also referred to as "double wefts") are wefts formed by a forward and back pass of the weft yarn adjacent one another and received in the same warp sheds across the width of the tape, i.e., are are received beneath the same warp passes.

The continuous coupling element 2 is in the form of a coil with the shanks of the synthetic resin monofilament likewise forming double wefts, i.e. both shanks 9 of each coupling member lie in a common warp shed or pass. In the embodiments illustrated the shanks 9 extend rearwardly from a coupling head 11 formed as a loop or eye and interdigitatable, as illustrated in FIG. 1 between the coupling heads of the opposing coupling elements.

Each coupling head 11 and the associated shanks 9 form a respective coupling member, generally designated at 10, which is connected to the adjacent coupling members by bights 12.

Customarily two stringer halves as shown in FIG. 1 have their coupling elements interdigitatable upon movement of a slider along the stringer formed by the two halves and constituting the slide fastener therewith.

The shanks 9 of each coupling member 10 are so arranged that one lies above the other and the two shanks have a common projection, between the head and the respective bights, in the slide fastener plane.

The ground weft thread 3 is, therefore, formed into the two double wefts 8 which reach across the entire tape to the region of the coupling heads 11 of the coupling members 10, these coupling heads projecting beyond the edge of the tape.

The coupling members are held in place by the connective sheds (passes) of the warp yarns 4, 5, 6 and 7 which pass over the shanks of the coupling members and anchor the coupling element at the support tape 1.

Figure 2:
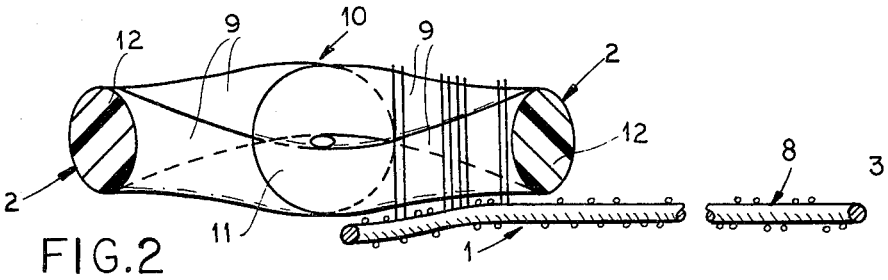
FIG. 2 is a view in section taken in the direction of arrow II of FIG. 1.

In the embodiment of FIGS. 1 through 3, each two double wefts 8, i.e. the double wefts in pairs, are received in respective tape warp sheds 13 below the coupling element 10. The warp sheds 13 are in part formed by the warp threads 4, 5, 6, 7 which extend out of the slide fastener plane and over the respective shanks 9 of the coupling members 10 in the manner previously described.

The warp sheds 14, i.e. the connective sheds, are formed by the warp threads 4–7 above the tape plane. The shed of shanks of a coupling member and the shed of the double weft of the tape underlying same are formed by different groups of warp yarns and hence are different sheds offset from one another in a direction orthogonal to the plane of the tape.

This construction affords all of the advantages previously asserted since the weft 3 and the coupling element 2 can move relatively under bending and buckling stresses in the slide fastener plane or out of the slide fastener plane without allowing the interhead spacing to be modified significantly. However, since the number of anchoring warp yarns 4–7, the thickness thereof and the tension of these warp yarns can be selected as desired, the stability of the stringer is ensured and the pliability and softness can be selected accordingly.

Between the double wefts 8 of the ground-weave weft yarn 3, which lie below the coupling members 10, there are formed double weft passes 8*a* of the ground weave approximately centrally between the adjacent members 10.

In the embodiment of FIG. 4, therefore, each other pair of double wefts 8*a* are located in a respective tape shed 13 while three successive pairs of shanks are received in a connective shed 14 whose weft yarns 4, 5, 6, 7 each span three adjacent coupling members 10.

Figure 5:
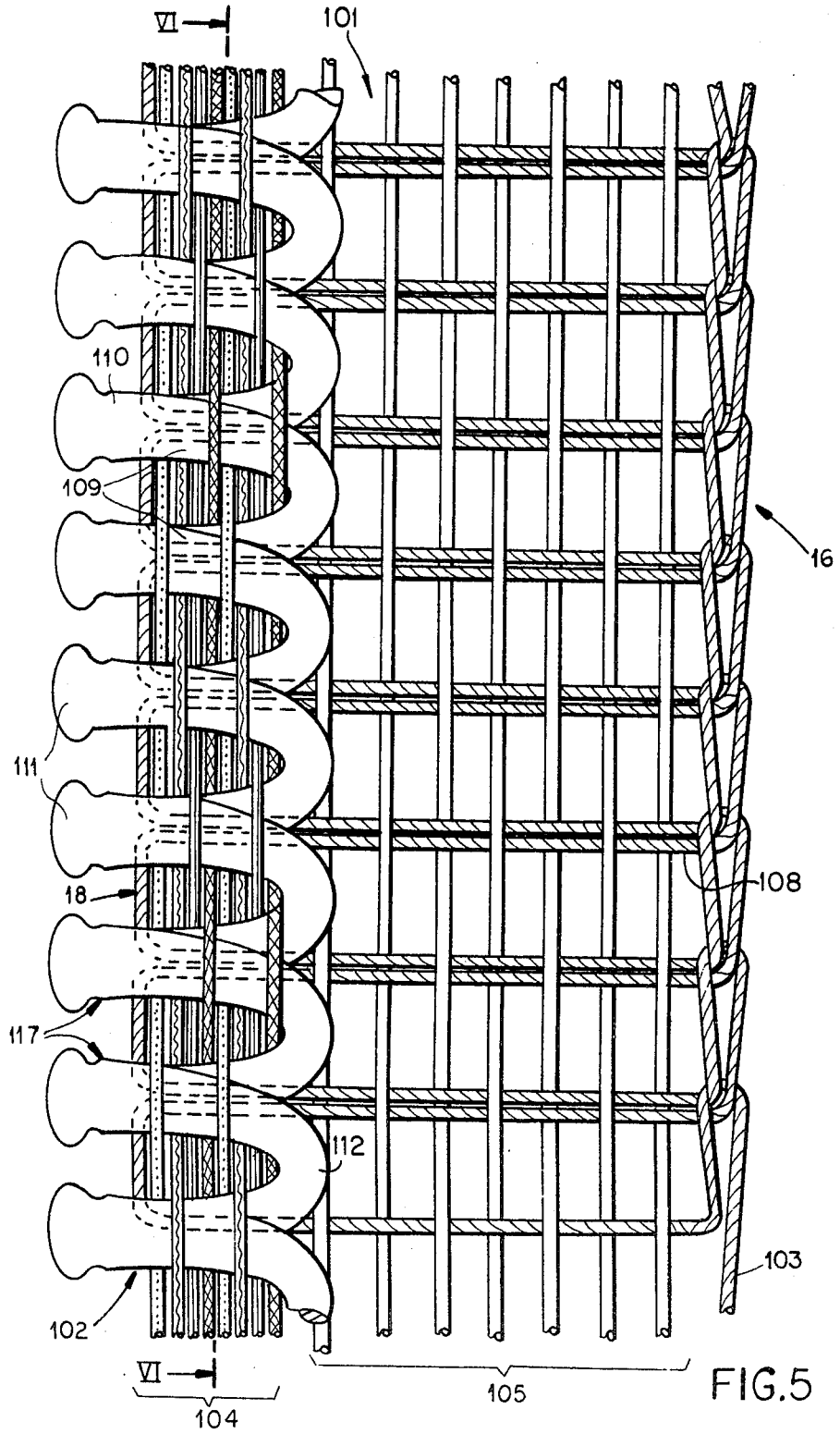
FIG. 5 is a plan view similar to FIG. 1 but illustrating a slide-fastener stringer half according to yet another embodiment of the invention.
Figure 6:
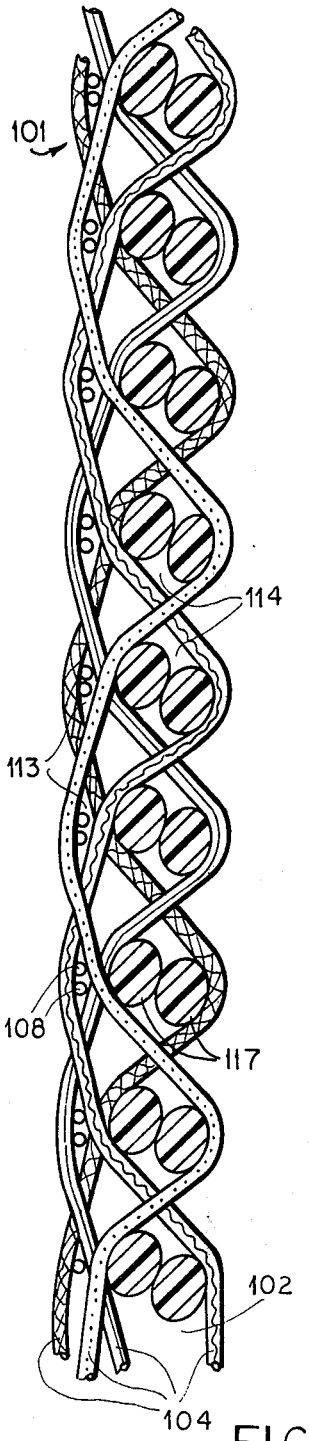
FIG. 6 is a cross-sectional view taken along line VI of FIG. 5.

In the embodiment of FIGS. 5 and 6, the woven tape 101 has a coupling element 102 incorporated therein by weaving and engaged by the warp yarns 104. The warp yarns 105 form part of the ground weave of the tape which has, as described, a weft yarn 103 which, at the edge remote from the coupling element, the weft passes looped together in the knitted edge 16.

Here as well the coupling heads 111 of the coupling members 110 project beyond the edge 18 of the tape. The shanks 109 of the coupling members 110 are superposed as described so that they have a common projection on the slide fastener plane, the shanks being interconnected by the bights 112.

The ground weave weft 3 is in the form of the double wefts 108 which extend over the full width of the tape, one double weft 108 being provided for each coupling member 110.

The shanks of the coupling members 110 are provided as double wefts 117.

As can be seen from FIGS. 5 and 6, the double wefts 108 and 117 of the stringer half are received in respective shed 113, 114 which are offset from one another although the sheds are separate in a direction orthogonal to the slide fastener plane. Thus each of the warp threads 104 has a high-middle-low-middle repeating pattern in which, at "high" position the warp thread passes over the monofilament double weft 117. In each "middle" position, the warp thread passes between a monofilament double weft 117 and the underlying double weft 108 while in the "low" position the warp passes under a double weft 108 of an adjoining coupling member. The relationship from one warp yarn 104 to the next is offset so that each warp yarn can pass beneath, say, three coupling members and when eight warp yarns 104 are used, as is preferred, each fourth warp yarn passes over a given coupling member.

Figure 7:
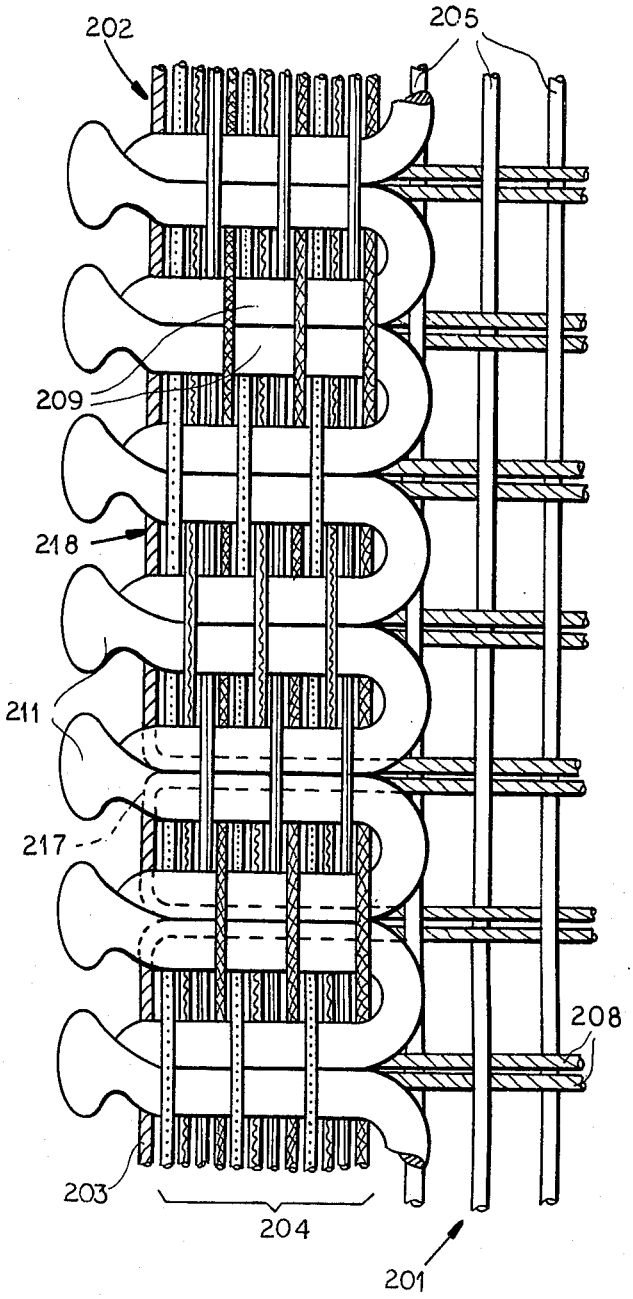
FIG. 7 is a fragmentary view similar to that of FIG. 5 but illustrating another embodiment.

The embodiment of FIG. 7 differs from that of FIGS. 5 and 6 in that the double wefts 217 formed by each pair of shanks 209 of a given coupling head 211 lie substantially side by side and the shanks are longer than those of the FIGS. 5 and 6 embodiment so that a greater number of warp threads 204 can form the connective shed. The edge 218, as in the case of FIGS. 5 and 6, is formed by the weft yarn 203 whose double wefts 208 are interwoven with the warp yarns 205 over the balance of the tape 201. This modified coupling element 202 can also be used in the FIG. 1 embodiment. Preferably twelve warp threads 204 are used to anchor the coupling element 202 in place.

We claim:

1. A slide fastener stringer half comprising a woven tape and a continuous monofilament coupling element interwoven with said tape, said tape being formed with a ground weft comprised of a plurality of double-pick weft insertions extending transversely of said tape and interlaced with warp yarns, said coupling element being formed of double-pick weft insertions and being provided with a multiplicity of coupling members each having a head overhanging an edge of said tape and a pair of shanks extending inwardly from said edge, said head and the respective shanks being integrated in the double-pick weft insertion of the coupling element, said warp yarns including connective warp threads interlaced with the double-pick weft insertions of said ground weft and with the double-pick weft insertions of said coupling element inwardly of said edge of said tape such that the warp threads pass over and under said double-pick weft insertions in a staggered pattern and each of said warp threads passes in succession over only a single double-pick weft insertion of said coupling element, under two successive double-pick weft insertions of the ground weft, and between the next two double-pick weft insertions of the ground weft and a double-pick weft insertion of said coupling element before entering a pattern repeat, a respective double-pick weft insertion underlying each double-pick weft insertion of said coupling element, and a further double-pick weft insertion of said ground weft being disposed between successive double-pick weft insertions of said coupling element.

2. A slide-fastener stringer half comprising a woven tape and a continuous monofilament coupling element interwoven with said tape, said tape being formed with a ground weft comprised of a plurality of double-pick weft insertions extending transversely of said tape and interlaced with warp yarns, said coupling element being formed of double-pick weft insertions and being provided with a multiplicity of coupling members each having a head overhanging an edge of said tape and a pair of shanks extending inwardly from said edge, said head and the respective shanks being integrated in two double-pick weft insertions of the coupling element, said warp yarns including connective warp threads interlaced with the double-pick weft insertions of said ground weft and with the double-pick weft insertions of said coupling element inwardly of said edge of said tape such that the warp threads pass over and under said double-pick weft insertions in a staggered pattern with each of said warp threads passing in succession over at least three double-pick weft insertions of said coupling element, under a double-pick weft insertion of the ground weft beneath the next double-pick weft insertion of said coupling element, between the next two double-pick weft insertions of the ground weft and the next double-pick weft insertion of the coupling element, and beneath the next double-pick weft insertion of the ground weft before entering a pattern repeat, a respective double-pick weft insertion underlying each double-pick weft insertion of said coupling element, and a further double-pick weft insertion of said ground weft being disposed between successive double-pick weft insertions of said coupling element.

3. The stringer half defined in claim 1 or claim 2 wherein said coupling members each have a pair of shanks forming a common projection on the stringer plane.

4. The stringer half defined in claim 1 or claim 2 wherein each of said warp threads runs over and under a plurality of double-wefts in forming tape warp passes for the ground weft between connective passes.

5. The stringer half defined in claim 1 or claim 2 wherein a multiple of four such warp threads are provided.

* * * * *